US007159266B2

(12) United States Patent
Santos

(10) Patent No.: US 7,159,266 B2
(45) Date of Patent: Jan. 9, 2007

(54) BRUSH HANDLE CONSTRUCTION

(75) Inventor: Fernando Jesus Santos, Maceira (PT)

(73) Assignee: The Libman Company, Arcola, IL (US)

( * ) Notice: Subject to any disclaimer, the term of this patent is extended or adjusted under 35 U.S.C. 154(b) by 474 days.

(21) Appl. No.: 10/769,596

(22) Filed: Jan. 30, 2004

(65) Prior Publication Data

US 2005/0166346 A1 Aug. 4, 2005

(51) Int. Cl.
*A46B 5/00* (2006.01)

(52) U.S. Cl. ..... 15/143.1; 16/421; 16/431; 16/DIG. 12

(58) Field of Classification Search ..... 15/143.1; 16/421, 431, DIG. 12
See application file for complete search history.

(56) References Cited

U.S. PATENT DOCUMENTS 264,798 A * 9/1882 Tyler ..... 81/489
1,421,098 A * 6/1922 Phillips ..... 74/551.9
3,189,069 A * 6/1965 Stowell ..... 81/177.1
3,302,673 A * 2/1967 Forsberg ..... 81/492
4,729,271 A * 3/1988 Kenigson ..... 81/177.1

* cited by examiner

*Primary Examiner*—Mark Spisich
(74) *Attorney, Agent, or Firm*—Banner & Witcoff, Ltd.

(57) ABSTRACT

A handle construction for a brush handle that includes a molded plastic handle body having a generally straight centerline axis extending from an annular flange outwardly to a distal end, where the body includes a longitudinal axial groove extending inwardly from the distal end toward the flange. The handle body also includes an arcuate groove transverse to the axis at the distal end, and a circumferential groove defining an opposing flange to the first flange. The handle construction also includes an elastomeric material gripping sleeve formed with an open end joined to a hollow passage sized and shaped to slide longitudinally axially onto the handle and including a closed end. It also includes an internal inwardly projecting rib defining a key for cooperatively engaging and fitting into the axial handle groove to guide the sleeve onto the handle, and further includes an internal circumferential rib for engaging the circumferential groove to retain the sleeve on the handle.

6 Claims, 4 Drawing Sheets

BRUSH HANDLE CONSTRUCTION

BACKGROUND OF THE INVENTION

The present invention relates generally to a handle construction, and more particularly to a brush handle construction that has a molded plastic handle body and an elastomeric gripping sleeve.

Handles for brushes and the like have numerous applications, including various cleaning and maintenance applications as well as personal care needs. There is a need for an improved plastic handle with a gripping sleeve. Further, there is a need for an improved two-piece handle configuration that is easy to assemble, secure, and does not unnecessarily waste materials.

BRIEF SUMMARY OF THE INVENTION

A separate handle and gripping sleeve are engaged together to give a secure handle construction that may be used for multiple purposes. The section of the handle body used for construction of the invention is generally annular and extends outwards to a distal end. This section of the handle has a keyed groove, an arcuate groove at the distal end, and a circular groove. The hollow gripping sleep slides onto the handle, and it has a rib that cooperates with the keyed groove. The gripping sleeve also has an internal circumferential rib that engages the circumferential groove of the molded handle.

This invention overcomes some of the disadvantages of previous handle constructions by having a secure, easy to assemble two-piece handle that will not disengage during use. The handle construction is lightweight and minimizes wasted material.

Further, this invention is advantageous because it provides a two-piece handle construction where dirt or other materials cannot get in between the two parts when the parts are assembled.

Therefore, a convenient new structure has been developed for brush handles that can be used for a variety of different applications.

BRIEF DESCRIPTION OF SEVERAL VIEWS OF THE DRAWINGS

The invention may be better understood by referring to the accompanying drawings, in which.

DETAILED DESCRIPTION OF THE INVENTION

Figure 1:
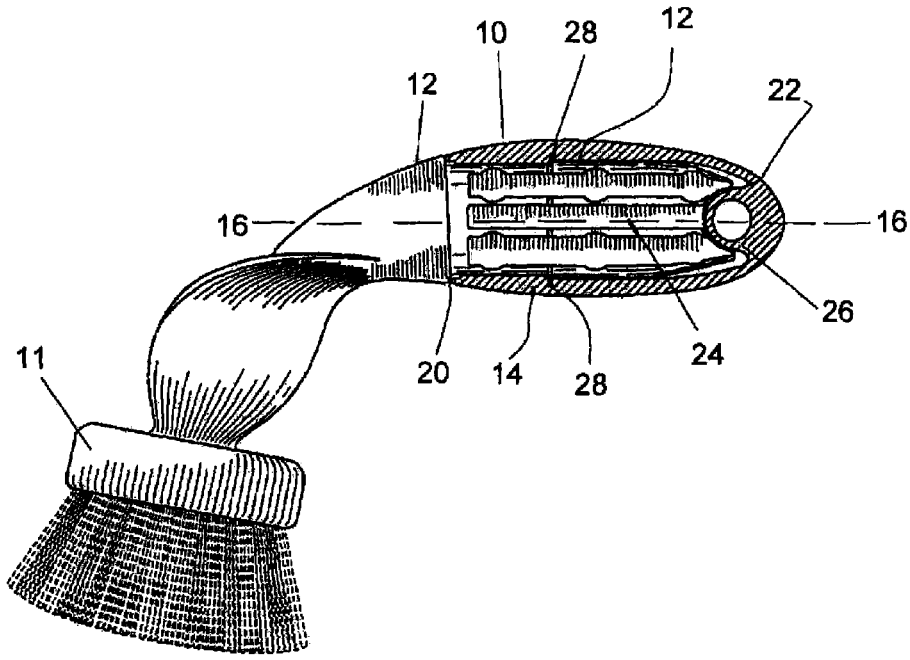
FIG. 1 is a left side view of a handle construction in accordance with one embodiment of the invention.
Figure 2:
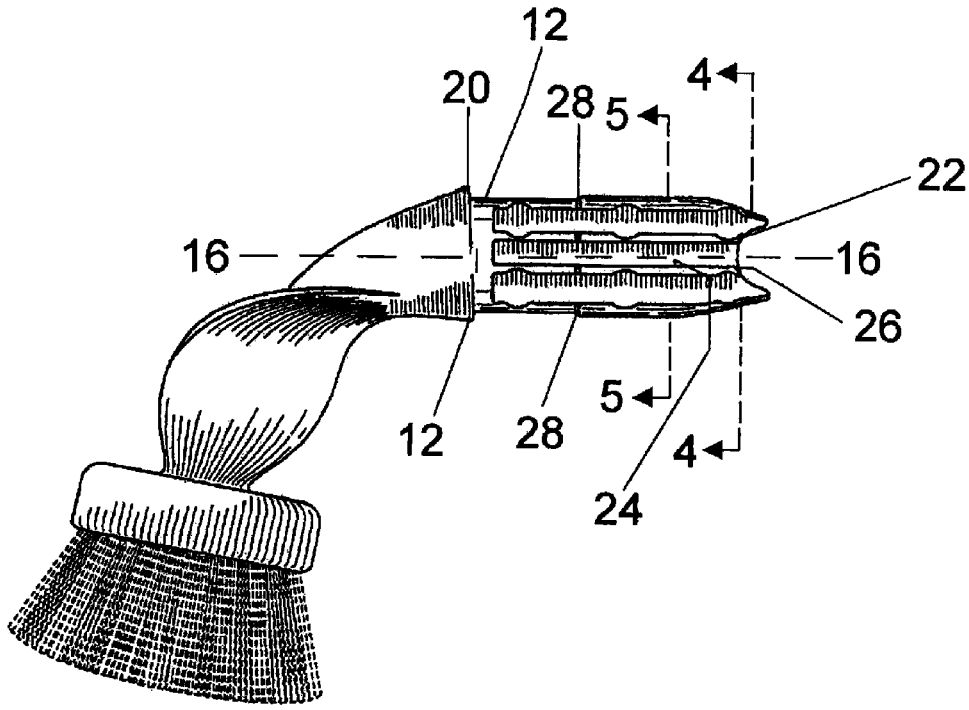
FIG. 2 is a left side view of a handle body seen in FIG. 1 with the gripping sleeve removed.
Figure 3:
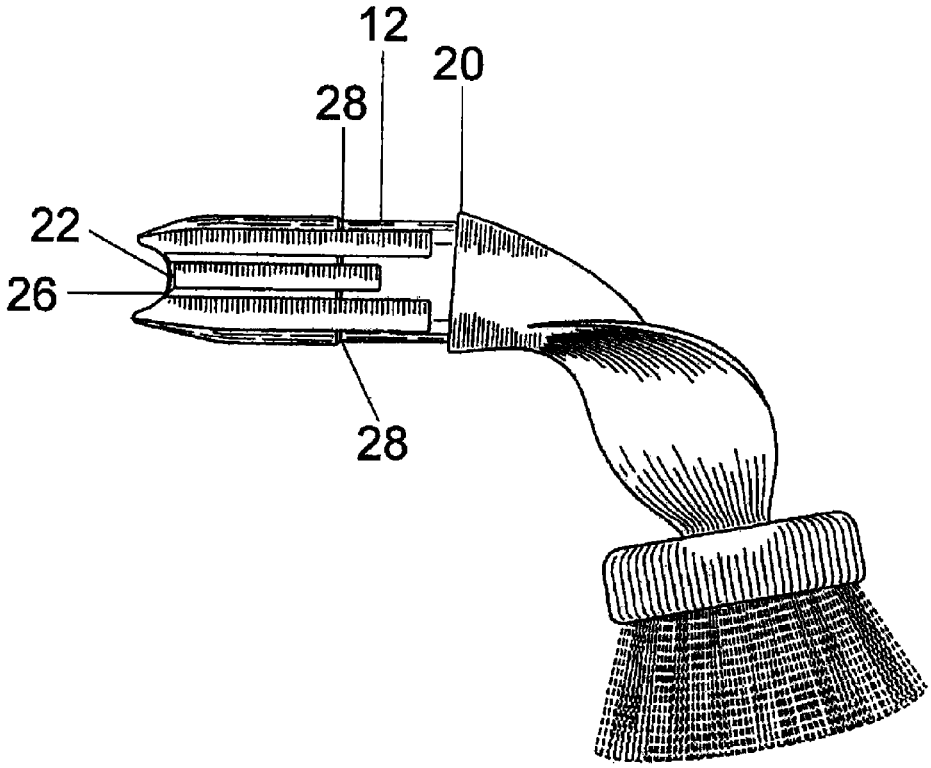
FIG. 3 is a right side view of a handle body seen in FIG. 1 with the gripping sleeve removed.

FIGS. 1 through 3 show one embodiment of a handle construction according to this invention. The handle construction 10 is generally composed of a handle body 12 and a gripping sleeve 14. The handle body 12 can be molded by any known method and it is typically made of plastic, though other materials may be used. The gripping sleeve 14 is made of a material suitable for gripping, such as an elastomeric material or similar material, though other materials may be used. In a preferred embodiment, the handle body 12 and/or the gripping sleeve 14 are generally cylindrical.

The brush handle is composed of the handle body 12 that receives the gripping sleeve 14. The handle body 12 extends generally from the brush portion 11 to a distal end 22 of the handle body 12. At a distance from the distal end 22 of the handle body 12, there is a generally annular flange 20. The handle body 12 has a generally straight centerline axis 16 that extends from the generally annular flange 20 through the distal end 22 of the handle body 12. The annular flange 20 projects annularly outwards from the handle body 12.

The handle body 12 has a longitudinal axial groove 24 that extends inwardly. In a preferred embodiment, the axial groove extends from the distal end 22 towards the annular flange 20. The length of the longitudinal axial groove 24 may vary depending on the length of the handle body 12. Generally, the groove 24 extends toward the annular flange 20 but not as far as the annular flange 20. Generally, the longitudinal axial groove does not extend past the annular flange 20.

Figure 4:
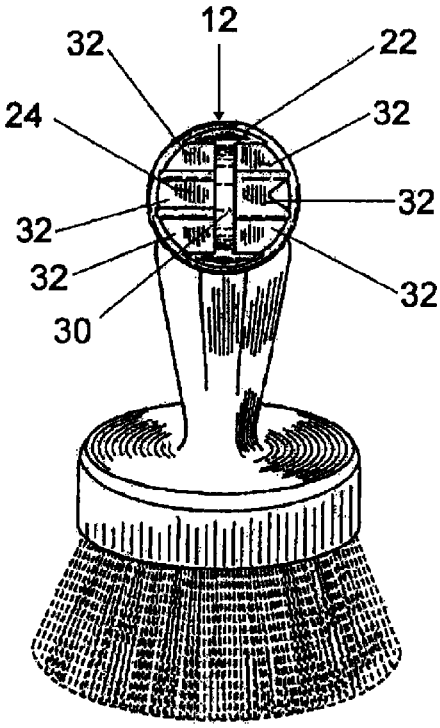
FIG. 4 is cross sectional view of the handle construction at 4–4 in FIG. 2.
Figure 7:
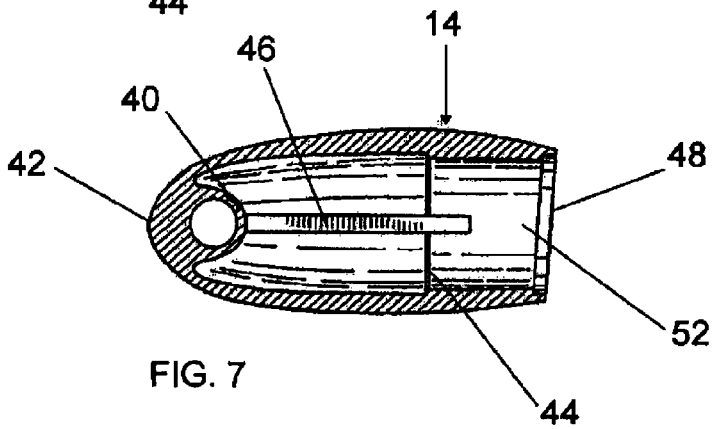
FIG. 7 is a cross sectional view of the other side of the gripping sleeve seen in FIG. 6, showing the internal inwardly projecting rib.

Referring also to FIG. 4, there is shown a preferred embodiment of a handle body 12 viewed from the distal end side of the handle body along cross-sectional line 4—4 as shown in FIG. 2. The axial groove 24 lies on a radius of the handle body 12. When assembled with the gripping sleeve, this axial groove receives the projecting rib from the gripping sleeve. Preferably, it is sized to receive the projecting rib 46 (FIG. 7).

The distal end 22 of the handle body 12 further has an arcuate groove 26 that lies generally transverse to the axis 16. The actual shape of the arcuate groove 26 may vary. In one embodiment, the arcuate groove 26 is generally circular. In this preferred embodiment, the gripping sleeve 14 has a molded generally circular cross section 40 at the closed end 42 of the gripping sleeve 14. This generally circular cross section 40 is molded so that when the gripping sleeve is engaged with the handle body 12, the cross section 40 will engage with the arcuate groove 26 of the handle body.

The handle body 12 further has a second groove 28. This groove 28 is generally circumferential and it is located on the handle body 12 between the distal end 22 and the annular flange 20. This groove 28 defines an opposing flange to the flange created by the annular flange 20, though this groove 28 typically is shorter in depth than the opposing flange created by the annular flange 20. When the gripping sleeve 14 is engaged on the handle body 12, the groove 28 acts to assist in engaging the circumferential rib 44 in the gripping sleeve 14.

Figure 6:
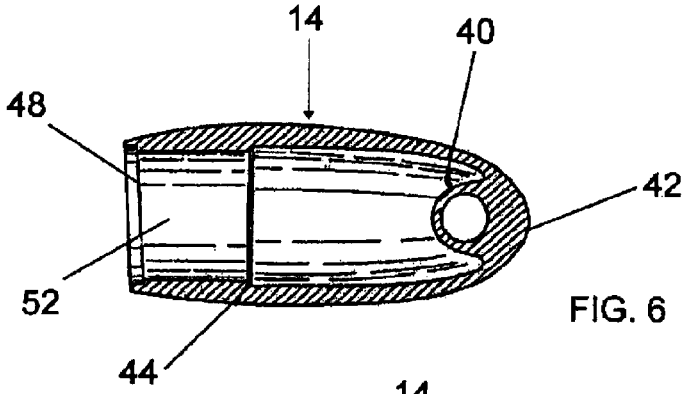
FIG. 6 is a cross sectional view of the gripping sleeve seen in FIG. 1.

The gripping sleeve 14 is typically made of a flexible material suitable for gripping, such as an elastomeric material. As shown in FIGS. 6 and 7, the gripping sleeve 14 generally has an open end 48 and a closed end 42. The gripping sleeve 14 is at least partially hollow, and thus has a hollow passage 52. This hollow passage functions to allow engagement with the handle body 12 during assembly of the handle. The gripping sleeve 14 is appropriately sized and shaped so that it will be able to slide axially onto the handle body 12.

Located inside the gripping sleeve 14 is an internal inwardly projecting rib 46. This projecting rib serves to define a key for cooperatively engaging and fitting into the axial groove 24 of the handle body 12. The projecting rib may take varied shapes and lengths, as long as it is able to cooperatively engage and fit into the axial groove 24. In a preferred embodiment, the projecting rib 46 is sized to fit into the axial groove 24. The projecting rib 46 preferably may have an axial dimension substantially equal to the axial dimension of the axial groove 24 of the handle.

Further, in a preferred embodiment, the projecting rib 46 projects in a rectangular shape and it is generally uniform along its length. In a preferred embodiment, the rib is located between the open end 48 and the circumferential rib 44 in the gripping sleeve and extends all the way to the inward end of the hollow passage 52. Other lengths may be used without departing from the scope of this invention. In a preferred embodiment, the projecting rib extends to the end of the hollow passage where the hollow passage meets the circular cross section 40 of the gripping sleeve 14.

The gripping sleeve 14 further includes an internal circumferential rib 44. This rib 44 is located inside the gripping sleeve between the open end 48 and the closed end 42. This internal circumferential rib 44 extends inwardly from the inner surface of the gripping sleeve 14. When the gripping sleeve 14 is engaged with the handle body 12, the internal circumferential rib 44 serves to engage the circumferential groove 28 of the handle body 12 to assist with retaining the gripping sleeve 14 on the handle body 12. In a preferred embodiment, the circumferential rib 44 has an axial dimension that is substantially equal to the axial dimension of the circumferential groove 28 of the handle body 12.

In one embodiment, the gripping sleeve 14 may further have a circumferential lip at the open end 48 of the gripping sleeve 14. This lip may function, at least in part, to more securely engage the gripping sleeve 14 onto the handle body 12 so as to prevent dirt or other unwanted debris or dirt from filling in the margin between the handle body 12 and the gripping sleeve 14.

To assemble the brush handle construction, the brush handle 12 is inserted into and engaged with the gripping sleeve 14. Typically, the gripping sleeve 14 is inserted longitudinally onto the handle body 12 so that the open end 48 of the gripping sleeve will engage the handle body up to the annular flange 20. During engagement of the gripping sleeve 14 with the handle body, the inwardly projecting rib 46 defines a key for cooperatively engaging and fitting into the axial handle groove 24 to guide the gripping sleeve 14 onto the handle body 12. Since the projecting rib 46 engages and fits into the axial handle groove 24, this prevents misalignment of the gripping sleeve, meaning that proper alignment is achieved by cooperatively engaging the key into the axial handle groove 24.

Further, as the handle body 12 is inserted into the gripping sleeve 14, the internal circumferential rib 44 inside the gripping sleeve 14 is engaged with the circumferential groove 28 of the handle body 12. This engagement serves to assist with retaining the gripping sleeve onto the handle. As the gripping sleeve is typically made of an elastomeric material, it can be made of an appropriate size so that when the projecting rib of the gripping sleeve is engaged into the axial handle groove of the handle body and the internal circumferential rib of the gripping sleeve is engaged with the circumferential groove of the handle body, the sleeve will be securely attached to the handle.

Figure 5:
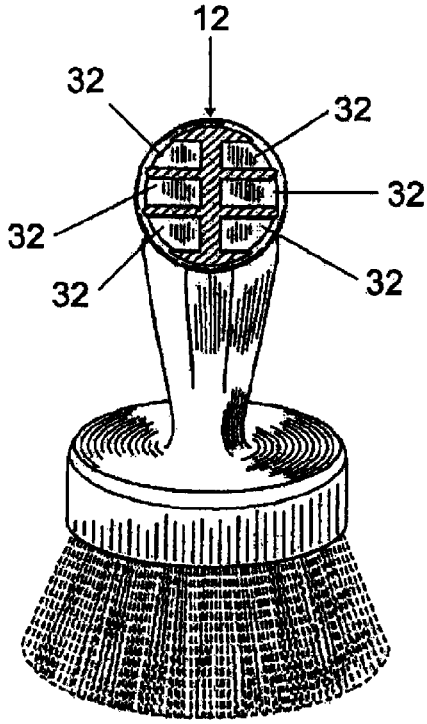
FIG. 5 is cross sectional view of the handle construction at 5–5 in FIG. 2.

In a preferred embodiment shown in FIGS. 4 and 5, the handle body 12 further includes a plurality of axially extending parallel slots 32, where one of the parallel slots comprises the axial groove 24. In this embodiment, the pairs of slots are separated by an axial rib 30 that is sized to engage the inside of the hollow passage 52 of the gripping sleeve 14 to maintain the shape of the gripping sleeve when the handle body 12 is inserted into the gripping sleeve.

This description of one embodiment of the invention has been provided merely for illustrative purposes. The scope of the invention is set forth in the following claims.

The invention claimed is:

1. A handle construction for a brush handle comprising, in combination:

a molded plastic handle body having a generally straight centerline axis extending from an annular flange outwardly to a distal end, said body including a longitudinal axial groove extending inwardly from the distal end toward the flange, said body including an arcuate groove transverse to the axis at the distal end, said body further including a circumferential groove defining an opposing flange to the first flange; and an elastomeric material gripping sleeve formed with an open end joined to a hollow passage sized and shaped to slide longitudinally axially onto the handle and including a closed end, an internal inwardly projecting rib defining a key for cooperatively engaging and fitting into the axial handle groove to guide the sleeve onto the handle, and further including an internal circumferential rib for engaging the circumferential groove to retain the sleeve on the handle.

2. The handle construction of claim 1 wherein the body and sleeve are generally cylindrical and the axial groove of the body lies on a radius of said body; and wherein the rib of the sleeve forms a radially inwardly member sized to fit in the axial groove.

3. The handle construction of claim 1 wherein the sleeve includes a molded circular cross section passage at the closed end transverse to the longitudinal axis and fitted into the arcuate groove of the handle.

4. The handle construction of claim 1 or claim 2 wherein the body includes a plurality of axially extending parallel slots including one of said slots comprising the axial groove, pairs of said slots separated by an axial rib sized to engage the inside of the hollow passage of the sleeve to maintain the shape of the sleeve.

5. The handle construction of claim 1 wherein the circumferential rib of the sleeve has an axial dimension substantially equal to the axial dimension of the circumferential groove in the handle.

6. The handle construction of claim 1 wherein the sleeve includes a circumferential lip at the open end which fits over the handle at the open end to prevent dirt from filling a margin between the handle and sleeve.

* * * * *